US010179356B2

(12) United States Patent
Voth et al.

(10) Patent No.: US 10,179,356 B2
(45) Date of Patent: Jan. 15, 2019

(54) METHODS AND APPARATUS TO CONTROL A HEM PROFILE OF STRIP MATERIAL

(71) Applicant: The Bradbury Company, Inc., Moundridge, KS (US)

(72) Inventors: Verne D. Voth, Hesston, KS (US); Gregory S. Smtih, McPherson, KS (US)

(73) Assignee: The Bradbury Company, Inc., Moundridge, KS (US)

( * ) Notice: Subject to any disclaimer, the term of this patent is extended or adjusted under 35 U.S.C. 154(b) by 0 days.

(21) Appl. No.: 14/303,486

(22) Filed: Jun. 12, 2014

(65) Prior Publication Data

US 2014/0290324 A1 Oct. 2, 2014

Related U.S. Application Data

(63) Continuation of application No. 12/332,079, filed on Dec. 10, 2008, now Pat. No. 8,783,081.

(60) Provisional application No. 61/013,471, filed on Dec. 13, 2007.

(51) Int. Cl.
*B21D 5/08* (2006.01)
*B21D 19/04* (2006.01)

(52) U.S. Cl.
CPC ..... *B21D 5/08* (2013.01); *B21D 19/04* (2013.01); *Y10T 29/53791* (2015.01)

(58) Field of Classification Search
CPC ..... B21D 19/04; B21D 5/08; B21D 13/045; B21D 39/02; B21D 39/023; B21D 5/083; Y10T 29/53791; Y10T 29/53709; B21B 27/021; B21B 27/02; B21B 31/20; B21B 31/24
USPC ..... 72/179–182, 214, 210, 220, 234, 176, 72/164
See application file for complete search history.

(56) References Cited

U.S. PATENT DOCUMENTS 1,184,947 A * 5/1916 Gossett et al. ..... B21C 37/101 72/181
3,791,185 A 2/1974 Knudson
3,889,618 A 6/1975 Jarvis et al.
4,843,696 A * 7/1989 Gentry ..... B21B 1/16 29/33 F
4,899,566 A 2/1990 Knudson
(Continued)

FOREIGN PATENT DOCUMENTS

WO 2006117896 9/2006
WO WO 2006117896 * 9/2006

OTHER PUBLICATIONS

United States Patent and Trademark Office, "Notice of Allowance," issued in connection with U.S. Appl. No. 12/332,079, dated Mar. 12, 2014, 27 pages.

(Continued)

*Primary Examiner* — Edward Tolan
(74) *Attorney, Agent, or Firm* — Hanley, Flight and Zimmerman, LLC

(57) ABSTRACT

Methods and apparatus for controlling a hem profile in roll-forming processes are described. An example roll-forming apparatus includes a first plurality of work rolls to form a first hem on a material and a second plurality of work rolls. One of the second plurality of work rolls is adjustable relative to an opposing work roll and to the first plurality of work rolls to adjustably control a profile of the first hem.

22 Claims, 10 Drawing Sheets

(56) References Cited

U.S. PATENT DOCUMENTS

| | | | | |
|---|---|---|---|---|
| 4,918,797 | A | 4/1990 | Watkins et al. | |
| 5,107,695 | A | 4/1992 | Vandenbroucke | |
| 5,163,311 | A * | 11/1992 | McClain | B21D 5/08 72/181 |
| 5,456,099 | A | 10/1995 | Lipari | |
| 5,934,544 | A * | 8/1999 | Lee | B21D 5/08 228/146 |
| 5,970,769 | A | 10/1999 | Lipari | |
| 6,148,654 | A | 11/2000 | Jensen et al. | |
| 6,209,374 | B1 | 4/2001 | Bradbury et al. | |
| 6,434,994 | B2 | 8/2002 | Bradbury et al. | |
| 6,477,879 | B1 * | 11/2002 | Sawa | B21D 39/021 29/243.58 |
| 8,783,081 | B2 * | 7/2014 | Voth | B21D 19/04 29/243.58 |
| 2003/0213276 | A1 | 11/2003 | Bodnar | |
| 2005/0284204 | A1 | 12/2005 | Carsley et al. | |
| 2008/0250835 | A1 * | 10/2008 | Hasegawa | B21D 39/021 72/220 |
| 2009/0151414 | A1 | 6/2009 | Voth et al. | |

OTHER PUBLICATIONS

United States Patent and Trademark Office, "Final Office Action," issued in connection with U.S. Appl. No. 12/332,079, dated Oct. 30, 2013, 16 pages.

United States Patent and Trademark Office, "Office Action," issued in connection with U.S. Appl. No. 12/332,079, dated Apr. 5, 2013, 19 pages.

United States Patent and Trademark Office, "Final Office Action," issued in connection with U.S. Appl. No. 12/332,079, dated Jan. 4, 2010, 12 pages.

United States Patent and Trademark Office, "Office Action," issued in connection with U.S. Appl. No. 12/332,079, dated Jun. 17, 2009, 63 pages.

* cited by examiner

METHODS AND APPARATUS TO CONTROL A HEM PROFILE OF STRIP MATERIAL

RELATED APPLICATION

This patent arises from a continuation of U.S. patent application Ser. No. 12/332,079, filed on Dec. 10, 2008, which claims priority to U.S. Provisional Patent Application No. 61/013,471, filed on Dec. 13, 2007, both of which are hereby incorporated herein by reference in their entireties.

FIELD OF THE DISCLOSURE

The present disclosure relates generally to roll-forming processes, and more particularly, to methods and apparatus to control a hem profile of strip material in roll-forming processes.

BACKGROUND

Roll-forming processes are typically used to manufacture components such as construction panels, structural beams, garage doors, and/or any other component having a formed profile. A roll-forming process may be implemented by using a roll-forming machine or system having a sequenced plurality of work rolls. Each work roll is typically configured to progressively contour, shape, bend, cut, and/or fold a moving material. The number of work rolls required to form a component may be dictated by the characteristics of the material (e.g., material strength, thickness, etc.) and the profile complexity of the formed component (e.g., the number of bends, folds, etc. needed to produce a finished component). The moving material may be, for example, strip material (e.g., a metal) that is pulled from a roll or coil of the strip material and processed using a roll-forming machine or system. As the material moves through the roll-forming machine or system, each of the work rolls performs a bending and/or folding operation on the material to progressively shape the material to achieve a desired profile. In some examples, the profile may be a cross section of a hem (i.e., a rolled or bent edge), which is typically either an open tear drop hem or a closed tear drop hem.

A roll-forming process may be a post-cut process or a pre-cut process. A post-cut process involves unwinding a strip material from a coil and feeding the continuous strip material through the roll-forming machine or system. In some cases, the strip material is leveled, flattened, or otherwise conditioned prior to entering the roll-forming machine or system. A plurality of bending, folding, and/or forming operations is then performed on the strip material as it moves through the work rolls to produce a formed material having a desired profile. The continuous formed strip material is then passed through the last work rolls and moved through a cutting or shearing press that cuts the formed material into sections having a predetermined length. In a pre-cut process, the strip is passed through a cutting or shearing press prior to entering the roll-forming machine or system. In this manner, pieces of formed material having a pre-determined length are individually processed by the roll-forming machine or system.

One known roll-forming machine incorporates a plurality of work rolls that are ganged (e.g., mechanically coupled and driven) together to form a hem on the top edge of a strip of material. Additionally, this known roll-forming machine includes a plurality of work rolls that are ganged together to form a flange on the bottom edge of the strip of material and a tab forming die to form a tab on the strip of material. The work rolls to form the hem, the work rolls to form the flange and/or the tab forming die are vertically adjustable to accommodate different strip heights. In operation, to complete the hem, the strip material is doubled over within the space provided between the last opposing hem forming work rolls.

Another known roll-forming machine incorporates a plurality of work rolls to form a hem on a material. The radius and shape of the last work roll (e.g., a finishing roll) controls the profile of the hem (e.g., typically either an open hem or a closed hem). To adjust the hem profile, an operator must remove and replace the last work roll with a work roll that has the desired radius and shape.

DETAILED DESCRIPTION

Figure 1:
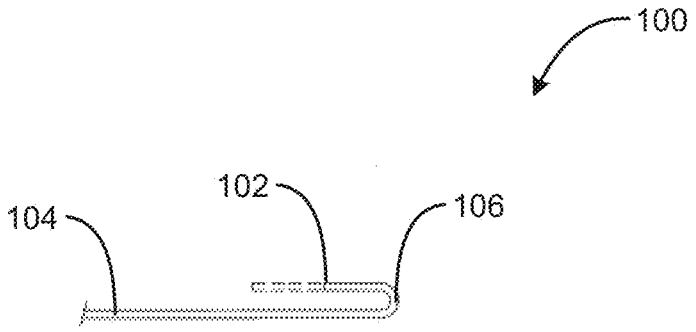
FIG. 1 PRIOR ART
FIG. 1 depicts a side view of a known open hem profile.

Certain examples are shown in the above-identified figures and described in detail below. In describing these examples, like or identical reference numbers are used to identify the same or similar elements. The figures are not necessarily to scale and certain features and certain views of the figures may be shown exaggerated in scale or in schematic for clarity.

Hemming may be the final forming operation and may involve the bending of sheet material onto the same piece of sheet material or onto another sheet of material to manufacture components such as garage doors, automotive components, roof panels, building frames and/or any other component having a hemmed edge. A piece of sheet material may be hemmed to create a uniform edge or to join together an inner piece of sheet material and an outer piece of sheet material. Additionally or alternatively, a piece of sheet material may be hemmed for a functional requirement of the manufactured component (e.g., to increase the stiffness of a manufactured component), for the appearance of the manufactured component, or for safety considerations (e.g., for safe handling of the manufactured component).

The example methods and apparatus described herein can be used to provide roll-forming processes to control a hem profile of strip material. As strip material is guided into the example roll-forming apparatus, a series of work rolls may bend and/or fold the material to progressively shape the material to achieve a desired hem profile. The series of work rolls may include a first series of work rolls that may be in-line or aligned with a second series of work rolls. The first and second series of work rolls may include a plurality of upper work rolls that correspond to a plurality of lower work rolls. The material processed by the example roll-forming apparatus may travel between the upper and lower work rolls to form a hem on the material.

The plurality of upper and lower work rolls of the first series of work rolls may be supported by upper and lower spindles, respectively, which are journalled in a base of the example roll-forming apparatus. Similarly, the plurality of lower work rolls of the second series of work rolls may be supported by a plurality of lower spindles rotatably journalled in the base.

The plurality of upper work rolls of the second series of work rolls may be supported by a plurality of upper spindles rotatably journalled in a pivot block. The pivot block may be hingeably coupled to the base via a pivot member. The pivot block may be adjustable relative to the base via a knob assembly to change a space between the pivot block and the base. Adjusting the space between the pivot block and the base may change the hem profile (e.g., closes the hem profile, opens the hem profile, etc.).

The example roll-forming apparatus may include one side or two sides that may be substantially identical or substantially mirror images of one other. If the example roll-forming apparatus includes two sides, the first side and the second side may be operatively coupled to one another via a plurality of cross members. Portions of the work rolls on the first side and portions of the work rolls on the second side may be operatively coupled to a drive unit that drives the work rolls via, for example, pulleys, gears, etc.

If the example roll-forming apparatus includes one side, the example roll-forming apparatus may form a hem that may be an open hem, a closed hem, or any other desired hem profile on a side of a material. However, if the example roll-forming apparatus includes two sides, the apparatus may form a first hem on a first side of a material and a second hem on a second side of the material. More specifically, the second hem may be positioned on the side of the material opposite the first hem. The first side and the second side may be independently adjustable to change the hem profile of the first hem and/or the second hem. Thus, the first side may form an open hem profile, a closed hem profile, or any other desired profile, and the second side may be adjusted independently to form an open hem profile, a closed hem profile, or any other desired profile.

FIG. 1 illustrates a side view of a known open hem profile 100. The open hem profile 100 has a flange 102, a body portion 104, and a bend 106. The open hem profile 100 may be a single piece of a material that is bent upon itself to a predetermined angle (e.g., an angle of 180 degrees, etc.) creating the bend 106. The flange 102 may be substantially parallel to the body portion 104. The open hem profile 100 may have an edge of a mating material (not shown) between the flange 102 and the body portion 104 to couple the material and the mating material together. Typically, the open hem profile 100 may be used, for example, to couple two sheet-metal components together.

Figure 2:
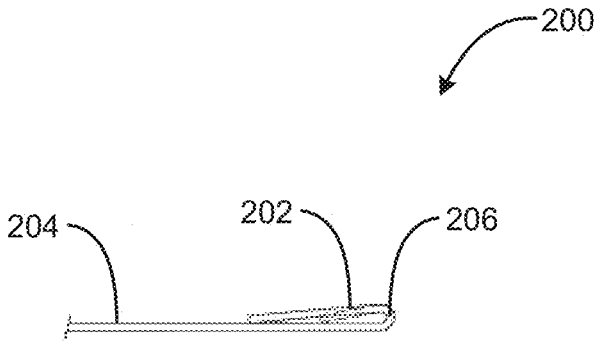
FIG. 2 PRIOR ART
FIG. 2 depicts a side view of a known closed hem profile.

FIG. 2 illustrates a side view of a known closed hem profile 200. The closed hem profile 200 has a flange 202, a body portion 204, and a bend 206. The closed hem profile 200 may be a single piece of a material that is bent upon itself to form, for example, a tear drop shaped hem (i.e., the material is bent to an angle greater than 180 degrees). The end of the flange 202 may come into contact with the body portion 204. However, the end of the flange 202 may not come into contact with the body portion 204 (not shown). The closed hem profile 200 may be used to create a uniform edge on the material, for safety considerations, or for any other application requiring a closed hem.

Figure 3:
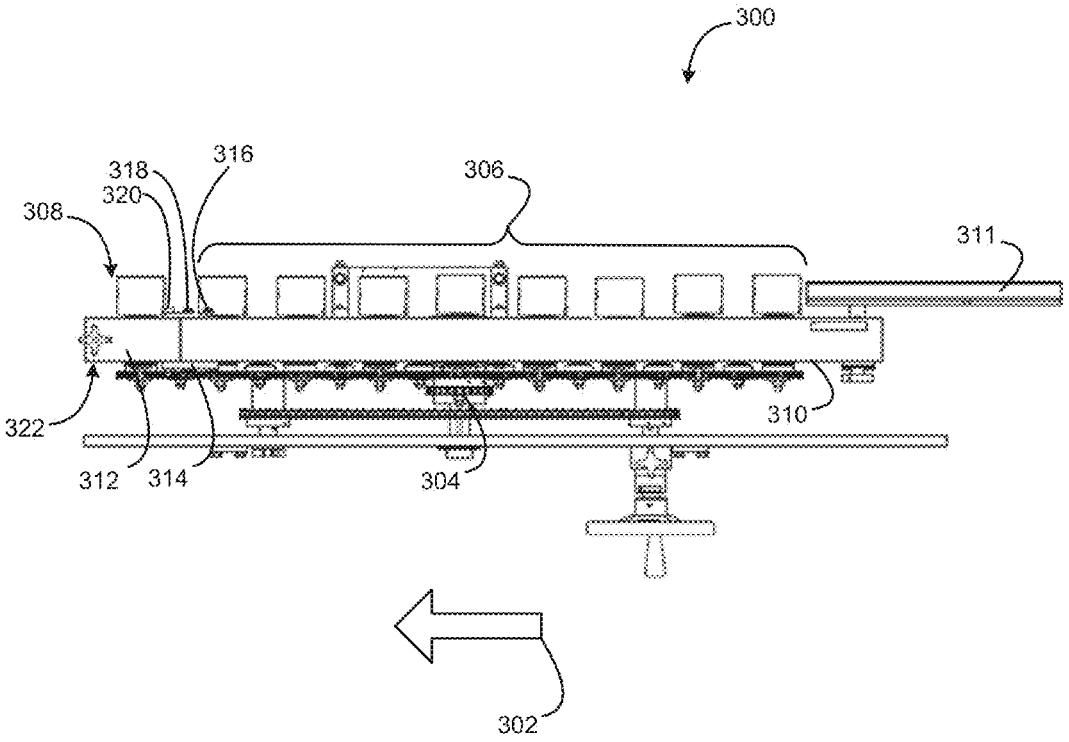
FIG. 3 depicts a top view of an example roll-forming apparatus that may be adjusted to control a hem profile.

FIG. 3 illustrates a top view of an example roll-forming apparatus 300 that may be adjusted to control a hem profile. The example roll-forming apparatus 300 may be part of, for example, a continuously moving material manufacturing system. Such a continuously moving material manufacturing system may include a plurality of subsystems that modify or alter a material using processes that, for example, unwind, fold, punch, and/or stack the material. The material may be a metallic strip or sheet material or may be any other metallic or non-metallic material. Additionally, the continuous material manufacturing system may include the roll-forming apparatus 300 which, as described in detail below, may be configured to form a component having a desired hem profile. By way of example, the open hem profile 100 (FIG. 1) and the closed hem profile 200 (FIG. 2) are described below in connection with FIGS. 3-11. The example open hem profile 100 (FIG. 1) and the example closed hem profile 200 (FIG. 2) may be formed using the example roll-forming apparatus 300. However, the example roll-forming apparatus 300 is not limited to forming, for example, the example hem profiles 100 and 200.

The roll-forming apparatus 300 may be configured to form, for example, the hem profiles 100 and 200 from a continuous material in a post-cut roll-forming process or from a plurality of sheets of material in a pre-cut roll-forming process. If the material is a continuous material, the roll-forming apparatus 300 may be configured to receive the material from an unwind stand (not shown) and drive, move, and/or translate the material in a direction generally indicated by arrow 302. Alternatively, the roll-forming apparatus 300 may be configured to receive the material from a shear (not shown) if the material is a pre-cut sheet of material (e.g., a fixed length of strip material).

The roll-forming apparatus 300 may include a drive unit 304, a first plurality of work rolls 306 and a second plurality of work rolls 308, as discussed in more detail below in connection with FIG. 4. The drive unit 304 may be operatively coupled and configured to drive portions of the first plurality of work rolls 306 and/or the second plurality of work rolls 308 via, for example, gears, pulleys, chains, belts, etc. Any suitable drive unit such as, for example, an induction motor, a hydraulic motor, a pneumatic motor, etc. may be used to implement the drive unit 304.

The first plurality of work rolls 306 may be in-line or aligned with the second plurality of work rolls 308. In the illustrated example, the first plurality of work rolls 306 and the second plurality of work rolls 308 are part of the same structure. In the alternative, the first plurality of work rolls 306 and the second plurality of work rolls 308 may be separate structures (not shown). The number of work rolls in the example roll-forming apparatus 300 may vary based on, for example, the strength, thickness, and type of material used as well as the type of hem profile desired.

The first plurality of work rolls 306 may work cooperatively to fold and/or bend material to form a hem such as, for example, the open hem profile 100. Each of the first plurality of work rolls 306 may be configured to apply bending forces to the material at predetermined folding lines as the material is driven, moved, and/or translated though the roll-forming apparatus 300. More specifically, as material moves through the roll-forming apparatus 300, each of the first plurality of work rolls 306 performs an incremental bending or forming operation on the material to form the hem. The material may be guided into the first plurality of work rolls 306 by a lead-in-guide 311.

The second plurality of work rolls 308 may work cooperatively to fold and/or bend the material to form the hem profile. Each of the second plurality of work rolls 308 may be configured to apply bending forces to the material at predetermined folding lines as the material is driven, moved, and/or translated though the roll-forming apparatus 300. More specifically, as the material moves through the roll-forming apparatus 300, the second plurality of work rolls 308 may be configured to form the hem profile such as, for example, the open hem profile 100 (FIG. 1), the closed hem profile 200 (FIG. 2), etc. However, the second plurality of work rolls 308 are not limited to forming the open hem profile 100 or the closed hem profile 200.

In the illustrated example, a pivot block 312 is hingeably coupled to a base 310 via a pivot member 314 (e.g., an elongated pivot arm or pivot arm). The pivot member 314 is coupled to the base 310 and the pivot block 312 by a plurality of fasteners 316, 318, and 320. The pivot block 312 may be adjustable relative to the base 310 via a knob assembly 322 (e.g., a telescoping assembly) to change the hem profile as described in detail below in connection with FIGS. 4 and 7.

Figure 4:
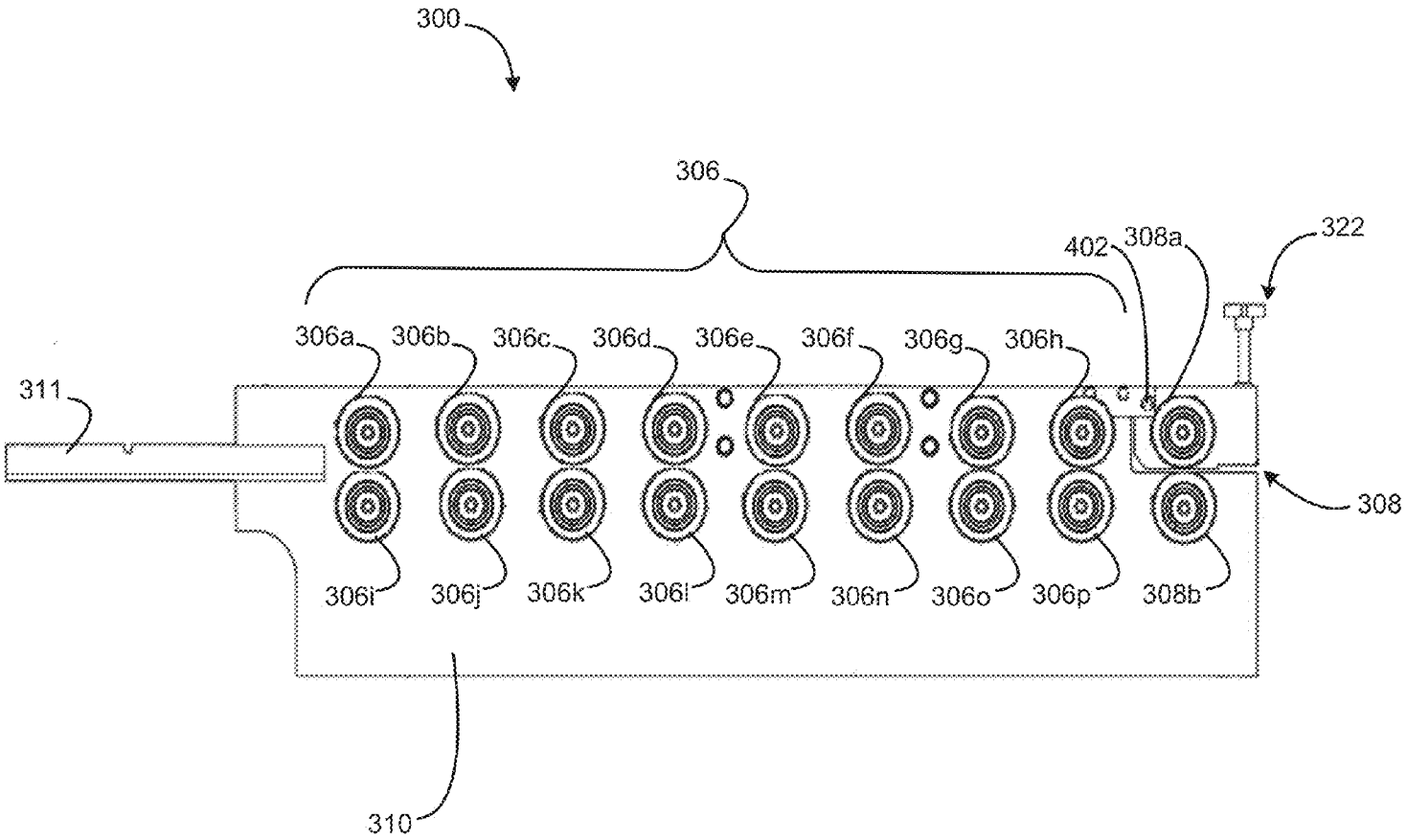
FIG. 4 depicts a side view of the example roll-forming apparatus of FIG. 3.

FIG. 4 is a side view of the example roll-forming apparatus 300 of FIG. 3. Any material capable of withstanding the forces associated with the bending of a material such as, for example, steel, may be used to implement the first plurality of work rolls 306 and/or the second plurality of work rolls 308. The first plurality of work rolls 306 and/or the second plurality of work rolls 308 may also be implemented using any shape suitable for performing a desired bending or folding operation (e.g., the open hem profile 100, the closed hem profile 200, etc.).

Figure 5:
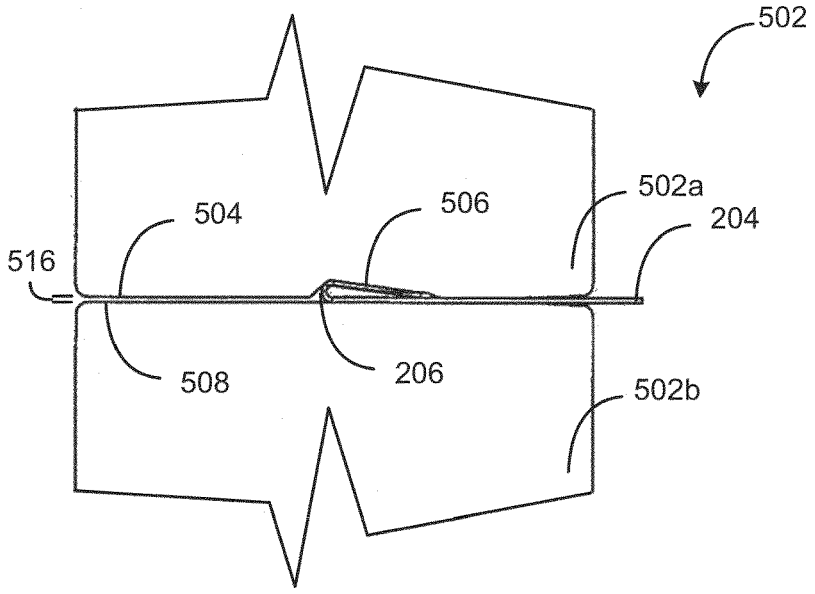
FIG. 5 depicts a portion of a second plurality of work rolls adjusted to form a closed hem profile that may be used to implement the example roll-forming apparatus of FIG. 3
Figure 6:
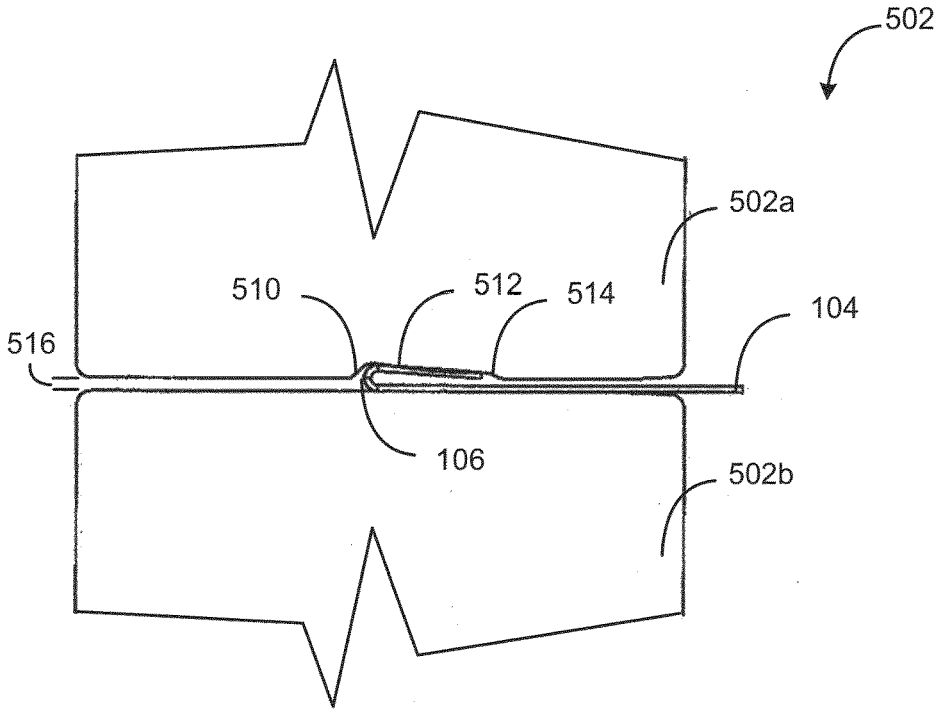
FIG. 6 depicts a portion of a second plurality of work rolls adjusted to form an open hem profile that may be used to implement the example roll-forming apparatus of FIG. 3.

Turning briefly to FIGS. 5 and 6, a second plurality of work rolls 502 are depicted that may be utilized to implement the second plurality of work rolls 308 of FIGS. 3 and 4. The second plurality of work rolls 502 include an upper work roll 502*a* and a lower work roll 502*b*. The upper work roll 502*a* includes a planar surface 504 adjacent a recess 506 and the lower work roll 502*b* includes a surface 508 that is relatively planar.

The recess 506 includes a first surface 510, a second surface 512 and a third surface 514. In some examples, a length of the first surface 510 may be relatively larger than a length of the third surface 514. In operation, the first surface 510 is configured to form the bend 106 or 206 and the second and third surfaces 512 and 514 are configured to form a particular hem profile based on a distance 516 between the upper work roll 502*a* and the lower work roll 502*b*.

FIG. 5 depicts the upper and lower work rolls 502*a* and 502*b* configured to form the closed hem profile 200 and FIG. 6 depicts the upper and lower work rolls 502*a* and 502*b* configured to form the open hem profile 100. In contrast to known roll-forming machines that require the work rolls be removed and replaced to change the hem profile, the examples described herein advantageously enable an operator to practically effortlessly change the hem profile by changing the distance 516 between the upper and lower works rolls 502*a* and 502*b*.

Turning back to FIG. 4, in the illustrated example, the first plurality of work rolls 306 may contain a plurality of upper work rolls 306*a-h* and a corresponding plurality of lower work rolls 306*i-p*. The plurality of upper work rolls 306*a-h* may be supported by a plurality of upper spindles 802*a*-816*a* (FIG. 8) rotatably journalled in the base 310. Likewise, the plurality of lower work rolls 306*i*-306*p* may be supported by a plurality of lower spindles 802*b*-816*b* (FIG. 8) rotatably journalled in the base 310. The material that passes through the roll-forming apparatus 300 may travel between the plurality of upper work rolls 306*a-h* and the plurality of lower work rolls 306*i-p* to form a hem on the material.

The second plurality of work rolls 308 may contain an upper work roll 308*a* and a lower work roll 308*b*. The upper work roll 308*a* may be supported by an upper spindle 818*a* (FIG. 8) rotatably journalled in the pivot block 312, and the lower work roll 308*b* may be supported by a lower spindle 818*b* (FIG. 8) rotatably journalled in the base 310. The material to be processed passes through the roll-forming apparatus 300 between the upper work roll 308*a* and the lower work roll 308*b* to form the hem profile (e.g., the open hem profile 100, the closed hem profile 200, etc.). In the alternative, the second plurality of work rolls 308 may contain a plurality of upper work rolls and a plurality of lower work rolls.

In the illustrated example, the second plurality of work rolls 308 may be adjusted to change the pressure being imparted on the hem, to change the hem profile (e.g., the open hem profile 100, the closed hem profile 200, etc.), etc. More specifically, the position of the upper work roll 308*a* in relation to the lower work roll 308*b* and the first plurality of work rolls 306 may be adjusted by the knob assembly 322.

Figure 7:
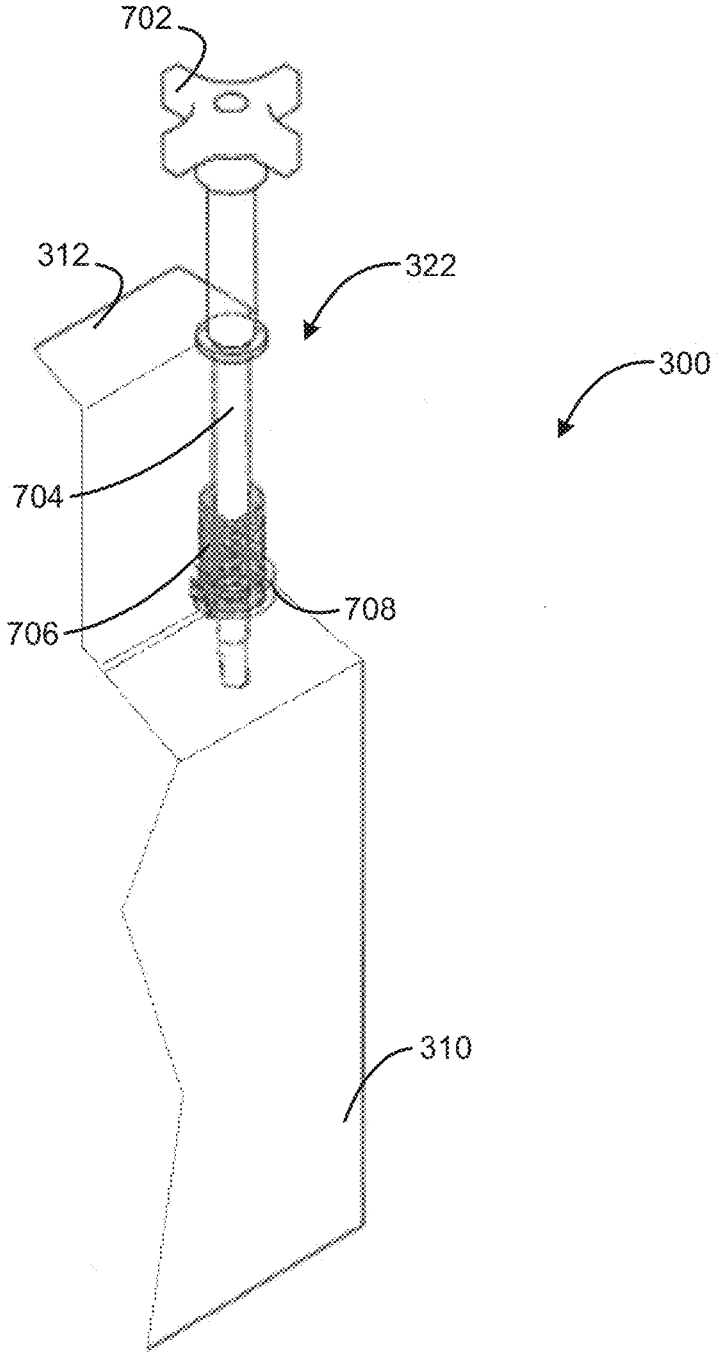
FIG. 7 depicts an enlarged cut-away view of a portion of the example roll-forming apparatus of FIG. 3.

FIG. 7 shows an enlarged cut-away view of a portion of the example roll-forming apparatus 300 of FIG. 3. FIG. 7 clearly depicts the mechanical relationship between the knob assembly 322, the pivot block 312, and the base 310. The knob assembly 322 may be coupled to the pivot block 312 and the base 310. The knob assembly 322 may include a knob 702, a shaft 704 (e.g., a tension bolt), a spring 706, and/or a spacer 708. The spring 706 may bias the pivot block 312 relative to the base 310 and may be positioned between the knob 702 and the spacer 708 on the knob assembly 322.

In operation, as the knob assembly 322 is adjusted (e.g., turned or rotated), the pivot block 312 may cause the upper work roll 308*a* to move along a curved or arcuate path toward or away from the lower work roll 308*b* (i.e., increasing or decreasing the pressure imparted on the hem and/or increasing or decreasing the distance between the upper work roll 308*a* and the lower work roll 308*b*) (FIG. 4). Decreasing the pressure on the hem may open the hem profile (e.g., shown in FIG. 6), while increasing the pressure on the hem may close the hem profile (e.g., shown in FIG. 5). Decreasing the distance between the upper work roll 308*a* and the lower work roll 308*b* may close the hem profile, while increasing the distance may open the hem profile. As the knob assembly 322 varies the distance between the upper work roll 308*a* and the lower work roll 308*b*, the pivot block 312 may be tilted or rotated about a pivot point 402 (FIG. 4) of the pivot member 314 (FIG. 3). In the alternative, as the knob assembly 322 is adjusted, the pivot block 312 may cause the upper work roll 308*a* to move in a substantially vertical path toward or away from the lower work roll 308*b*.

The knob assembly 322 may be coupled to or integrally formed with a threaded shaft that screws or threads into the base 310. In this manner, as the knob assembly 322 is operated (e.g., turned or rotated), the threaded shaft causes the upper work roll 308*a* via the pivot block 312 to move relative to the lower work roll 308*b*. The knob assembly 322 may be implemented using any actuation device capable of adjusting the position of the upper work roll 308*a* relative to the lower work roll 308*b*. For example, the knob assembly 322 may be implemented using a servo motor, a stepper motor, a hydraulic motor, a hand crank, a pneumatic piston, etc.

Figure 8:
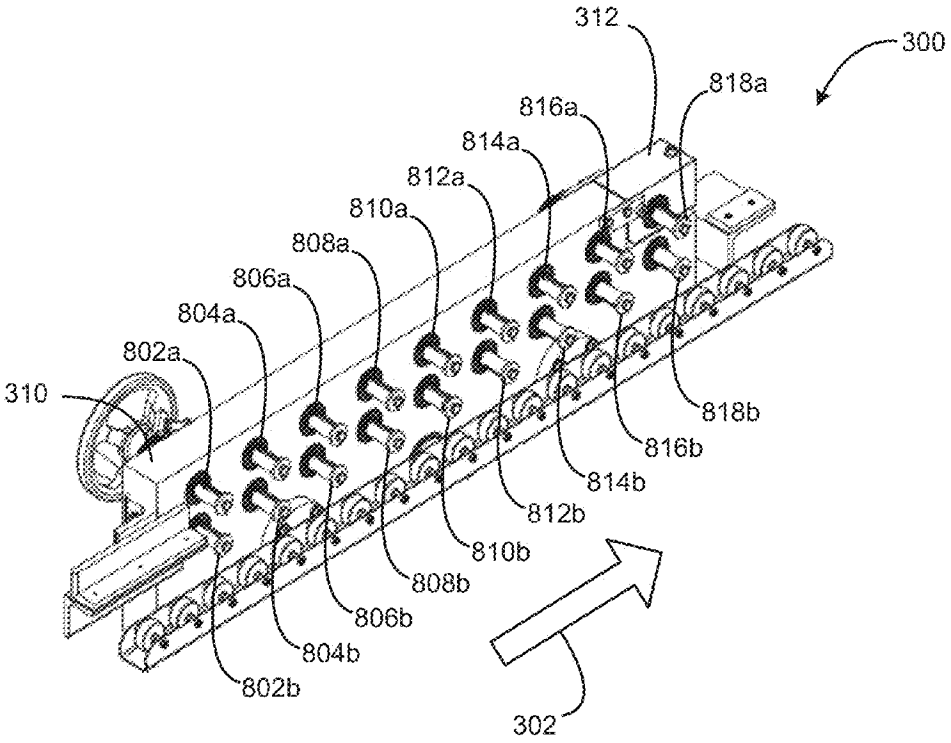
FIG. 8 depicts the example roll-forming apparatus of FIG. 3 without work rolls attached.

FIG. 8 depicts the example roll-forming apparatus 300 of FIG. 3 without the work rolls attached. FIG. 8 clearly depicts the relationship between the plurality of upper spindles 802*a*-816*a*, the plurality of lower spindles 802*b*-816*b*, the upper spindle 818*a*, the lower spindle 818*b*, the base 310, and the pivot block 312. The plurality of upper spindles 802*a*-816*a* and the plurality of lower spindles 802*b*-816*b* are rotatably journalled in the base 310. The upper spindle 818*a* is rotatably journalled in the pivot block 312, and the lower spindle 618*b* is rotatably journalled in the base 310.

Figure 9:
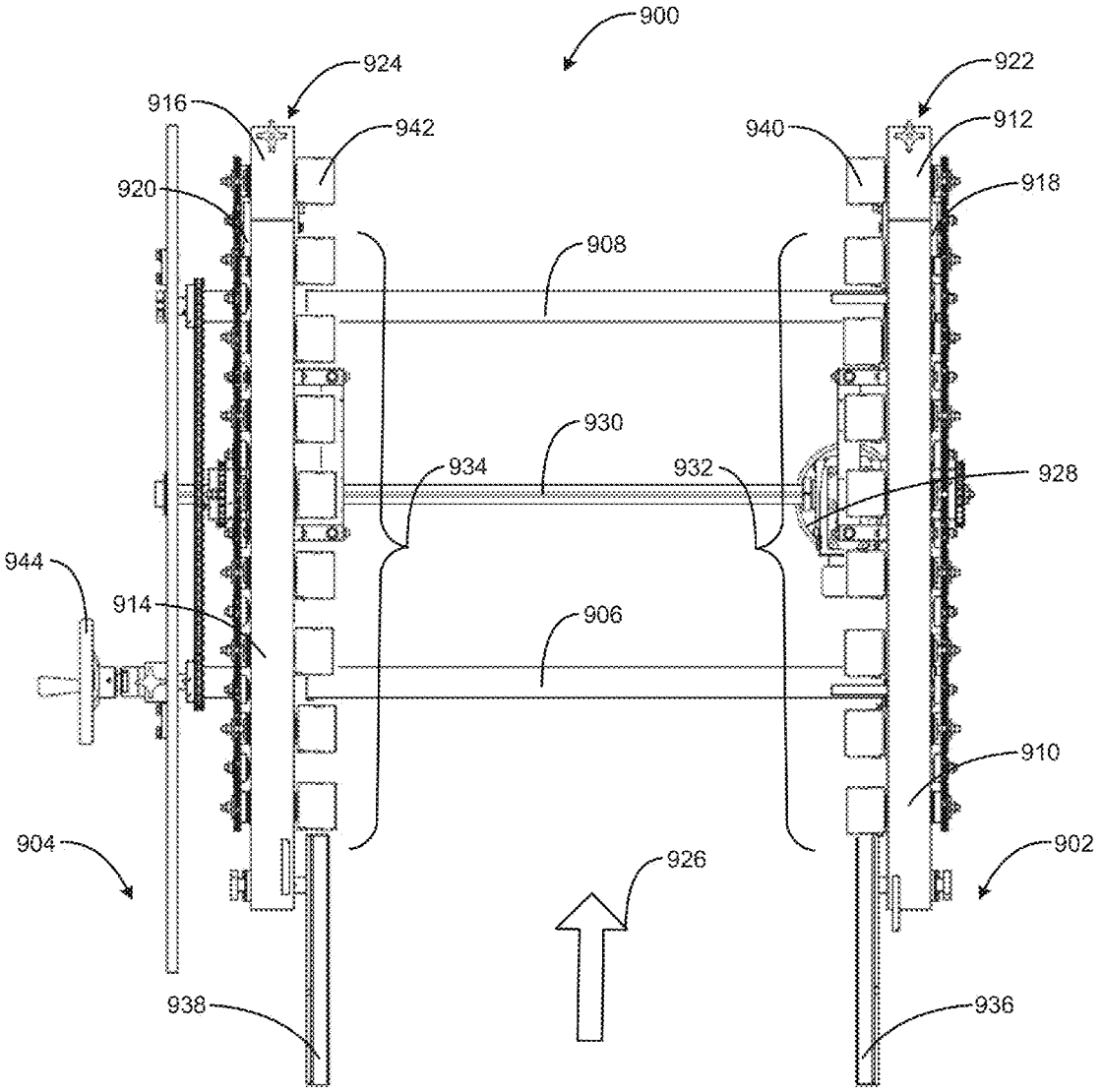
FIG. 9 depicts a top view of an example roll-forming apparatus that may be adjusted to change the hem profile of a first hem and/or a second hem.

FIG. 9 illustrates a top view of an example roll-forming apparatus 900 that may be adjusted to change the hem profile of a first hem and/or a second hem. The example roll-forming apparatus 900 includes a first side 902 and a second side 904. Each of the first side 902 and the second side 904 may be substantially similar to and/or substantially identical to the structure of the roll-forming apparatus 300 of FIGS. 3 and 4. The first side 902 and the second side 904 may be substantially mirror images of one another and may be operatively coupled to one another by a first member 906 and a second member 908. Alternatively, the first side 902 may be different from the second side 904. The first side 902 may include a base 910 that is coupled to a pivot block 912 via a pivot member 918. The pivot block 912 may be adjustable relative to the base 910 via a knob assembly 922 to change, for example, the pressure being imparted on a first hem on a first edge of a material, change the first hem profile, etc. as described above. Similarly, the second side 904 may include a base 914 that is coupled to a pivot block 916 via a pivot member 920. The pivot block 916 may be adjustable relative to the base 914 via a knob assembly 924 to, for example, change the pressure being imparted on a second hem on another edge of the material, change the second hem profile, etc. as discussed above. The adjustment of the knob assembly 922 of the first side 902 is independent from the adjustment of the knob assembly 924 of the second side 904.

The example roll-forming apparatus 900 may be configured to form two hem profiles (i.e., a first hem and a second hem) on opposite sides of a continuous material in a post-cut roll-forming process. If the material is a continuous material, the example roll-forming apparatus 900 may be configured to receive the material from an unwind stand (not shown) and drive, move, and/or translate the material in a direction generally indicated by arrow 926. Alternatively, the roll-forming apparatus 900 may be configured to receive the material from a shear (not shown) if the material is a pre-cut sheet of material (e.g., a fixed length of strip material).

The roll-forming apparatus 900 may include a drive unit 928 to drive the first side 902 and the second side 904. The drive unit 928 may be operatively coupled and configured to drive portions of the work rolls of the first side 902 and/or the second side 904 via, for example gears, pulleys, chains, belts etc. In the example roll-forming apparatus 900, the drive unit 928 is operatively coupled to drive portions of the work rolls of the second side 904 via a drive shaft 930.

The first side 902 may have a first plurality of work rolls 932 that work cooperatively to form the first hem on a material and the second side 904 may have a first plurality of work rolls 934 that work cooperatively to form the second hem on the material as described above. The first hem may be on the opposite side of the material from the second hem and may be, for example, a mirror image of or different from the second hem. The material may be guided into the first plurality of work rolls 932 and 934, by two lead-in guides 936 and 938, which may be positioned substantially parallel to one another.

The first side 902 may have a second plurality of work rolls 940 that work cooperatively to form the first hem profile, and the second side 904 may have a second plurality of work rolls 942 that work cooperatively to form the second hem profile. The configuration of the second plurality of work rolls 940 of the first side 902 may be performed independently from the configuration of the second plurality of work rolls 942 of the second side 904. For example, the first side 902 may be configured to form the open hem profile 100 and the second side 904 may be configured to form the closed hem profile 200. Alternatively, the first side 902 and the second side 904 may be configured to both form the closed hem profiles 200 or both form the open hem profiles 100, etc.

In addition, the roll-forming apparatus 900 may be adjusted to accommodate different sizes and/or widths of material. In some example, the roll-forming apparatus 900 may be provided with a width adjuster 944 that may be rotated to change (e.g., increase or decrease) the distance between the first side 902 and the second side 904.

Figure 10:
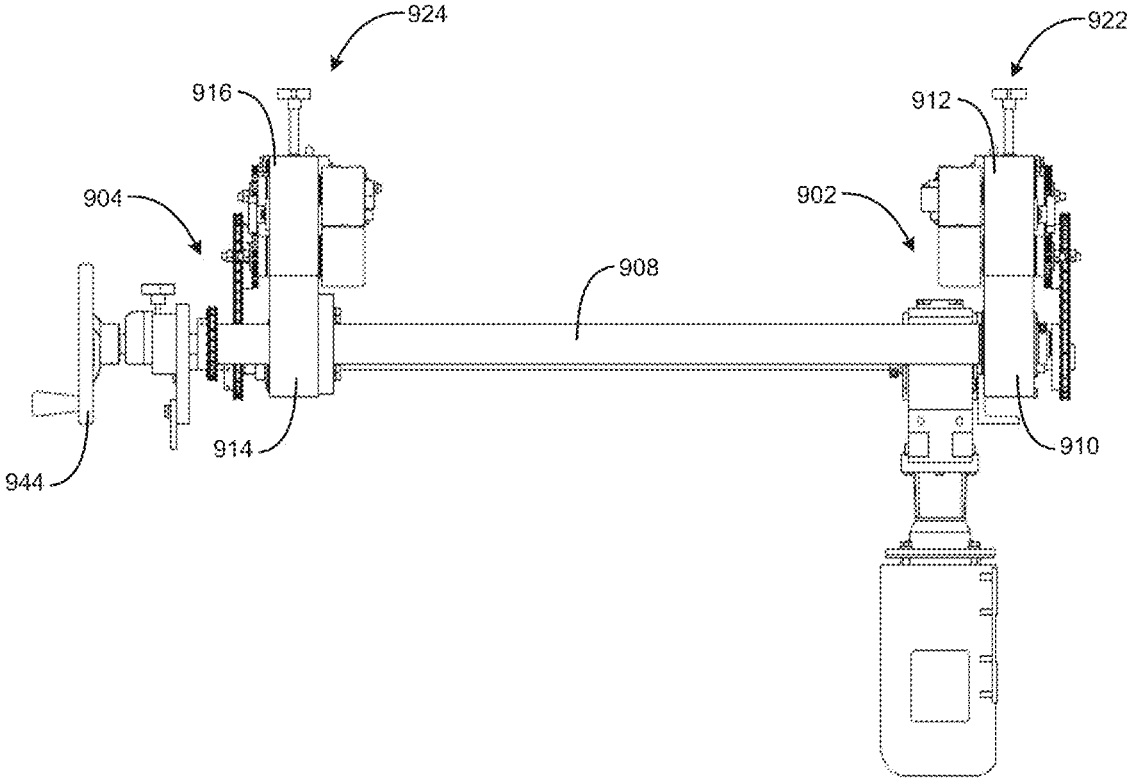
FIG. 10 depicts an exit end view of the example roll-forming apparatus of FIG. 9.

FIG. 10 shows an exit end view of the example roll-forming apparatus of FIG. 9. FIG. 10 clearly depicts the mechanical relationship between the first side 902, the second side 904, and the second member 908. FIG. 10 also depicts the relationship between the knob assemblies 922 and 924, the pivot blocks 912 and 916 and the bases 910 and 914.

Figure 11:
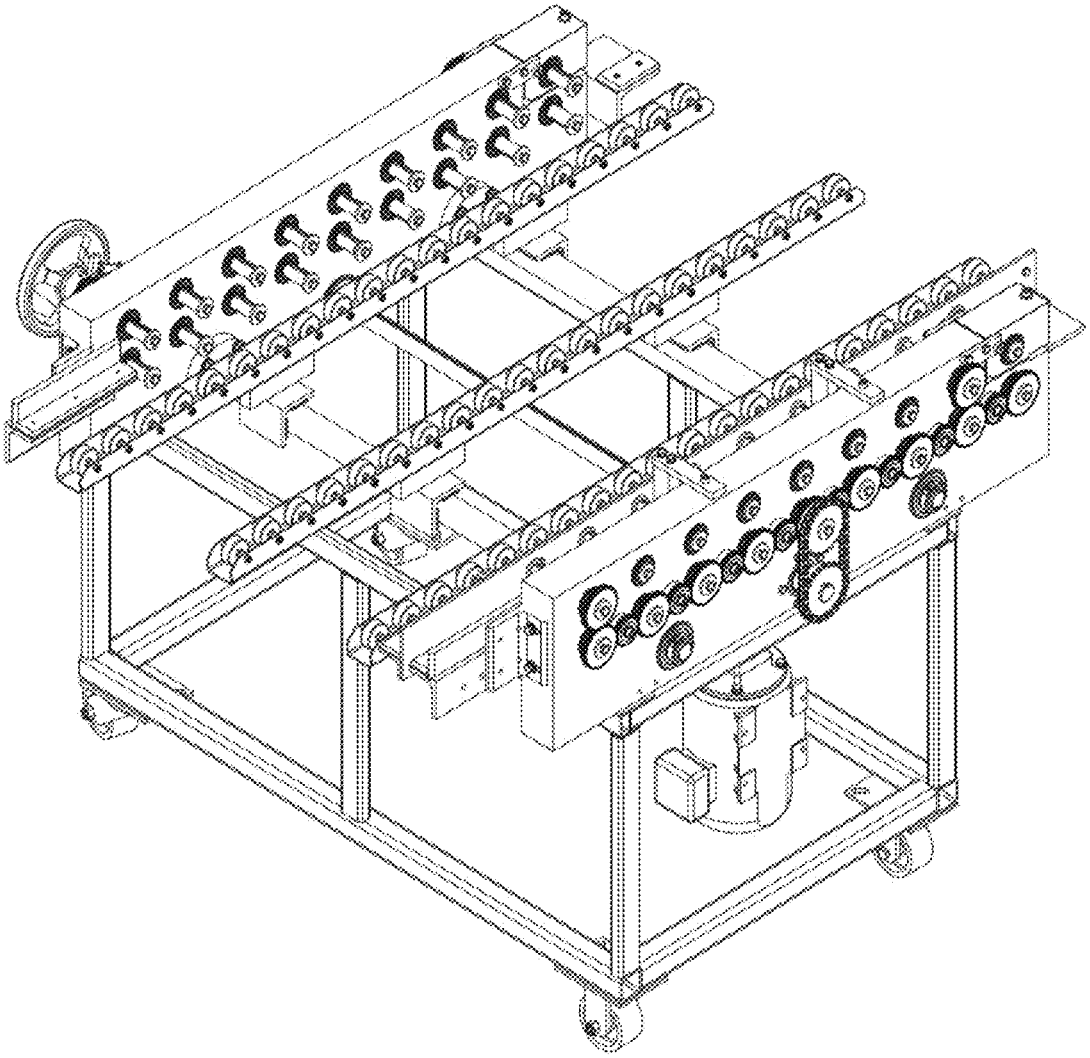
FIG. 11 depicts an isometric view of the example roll-forming apparatus of FIG. 9 without work rolls.

FIG. 11 shows an isometric view of the roll-forming apparatus of FIG. 9 without work rolls.

Although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A roll-forming apparatus, comprising:

a base;

a first work roll rotatably coupled to the base, the first work roll having a first planar surface in a first plane;

a second work roll coupled to the base, the second work roll having a second planar surface opposite the first planar surface in a second plane, a recess opposite the first planar surface, and a third planar surface opposite the first planar surface in the second plane, the recess including a first surface of the recess having a first length that extends from the second planar surface, a second surface of the recess, and a third surface of the recess having a second length greater than the first length and extending from the third planar surface, the second surface of the recess disposed between the first surface of the recess and the third surface of the recess, wherein the second work roll is rotatably coupled to a block movably coupled to the base; and an actuator to move the block relative to the base and to move the second work roll to different positions in which the second work roll engages a material to enable a profile of a hem of the material disposed in the recess to be continuously adjusted to different profiles between an open hem profile and a closed hem profile, the actuator to move the second work roll relative to the first work roll.

2. The apparatus of claim 1, wherein the actuator is rotatable to move the block relative to the base.

3. The apparatus of claim 1, wherein the actuator includes a mechanical actuator.

4. The apparatus of claim 1, wherein the actuator includes a tension bolt.

5. The apparatus of claim 1, wherein the block is pivotably coupled to the base.

6. The apparatus of claim 1, wherein the actuator includes a spring to springably bias the block relative to the base.

7. The apparatus as defined in claim 1, wherein the block is a first block and the actuator is a first actuator, further including:

a third work roll and a fourth work roll to form a second hem on the material opposite the first hem, the fourth work roll to control a profile of the second hem, the fourth work roll rotatably coupled to a second block movably coupled to the base; and a second actuator to move the second block relative to the base and to move the fourth work roll relative to the third work roll to enable the profile of the second hem to be continuously adjusted.

8. The apparatus of claim 7, wherein the first actuator and the second actuator are independently operable.

9. The apparatus of claim 8, wherein the first block and the second block are independently movable.

10. The apparatus of claim 1, wherein the actuator is to move the second work roll in a substantially vertical path.

11. The apparatus of claim 1, wherein the actuator includes a knob and a shaft, the shaft to extend through the block and into the base, the knob to be externally accessible to enable the shaft to be rotated to move the block relative to the base.

12. The apparatus of claim 1, wherein the actuator includes a manually operated actuator.

13. The apparatus of claim 1, wherein at least one surface defining the recess is non-parallel to the first planar surface of the first work roll.

14. The apparatus of claim 1, wherein the recess includes a first surface of the recess that extends from the second planar surface, a second surface of the recess that extends from the first surface of the recess, and a third surface of the recess that extends between the second surface of the recess and the third planar surface, wherein the first surface of the recess, the second surface of the recess, and the third surface of the recess non-parallel to the first planar surface.

15. The apparatus of claim 14, wherein the first surface of the recess is coupled directly to the second planar surface and the second surface of the recess and the third surface of the recess is coupled directly to the third planar surface and the second surface of the recess.

16. An apparatus comprising:

a base;

a first work roll rotatably coupled to the base, the first work roll having a first planar surface in a first plane;

a second work roll rotatably coupled to a block movably coupled to the base, the second work roll having a second planar surface opposite the first planar surface in a second plane, a recess opposite the first planar surface, and a third planar surface opposite the first planar surface in the second plane, the recess including a first surface of the recess having a first length that extends from the second planar surface, a second surface of the recess, and a third surface of the recess having a second length greater than the first length and extending from the third planar surface, the second surface of the recess disposed between the first surface of the recess and the third surface of the recess; and an actuator to move the block relative to the base and to move the second work roll to different positions in which the second work roll engages a material to enable a profile of a hem of the material disposed in the recess to be continuously adjusted to different profiles between an open hem profile and a closed hem profile, wherein the actuator extends through the block and threadably engages the base.

17. An apparatus comprising:

a base;

a first work roll rotatably coupled to the base, the first work roll having a first planar surface in a first plane;

a second work roll rotatably coupled to a block movably coupled to the base, the second work roll having a second planar surface opposite the first planar surface in a second plane, a recess opposite the first planar surface, and a third planar surface in the second plane, the recess being asymmetrical between the second planar surface and the third planar surface and extending from the second planar surface to a first depth at a first side of the recess and extending from the third planar surface to a second depth at a second side of the recess, the second depth different than the first depth; and an actuator to move the block relative to the base and to move the second work roll to different positions in which the second work roll engages a material to enable a profile of a hem of the material disposed in the recess to be continuously adjusted to different profiles between an open hem profile and a closed hem profile, the actuator to move the second work roll relative to the first work roll.

18. A method of using the roll-forming apparatus of claim 1, comprising:

moving the material through the first work roll and the second work roll to control a profile of a first hem; and continuously adjusting the profile of the first hem by moving the block and the second work roll relative to the first work roll.

19. The method of claim 18, further including:

moving the material between a third work roll and a fourth work roll to control a profile of a second hem, wherein the fourth work roll is rotatably coupled to a second block movably coupled to the base; and continuously adjusting the profile of the second hem by moving the second block and the fourth work roll relative to the third work roll.

20. The method of claim 19, wherein the first hem is opposite the second hem.

21. The method of claim 19, wherein the block and the second work roll are independently movable relative to the second block and the fourth work roll.

22. The method of claim 18, wherein moving the block and the second work roll relative to the first work roll includes moving the second work roll in a substantially vertical path.

* * * * *